US005819861A

United States Patent [19]

Scott et al.

[11] Patent Number: 5,819,861

[45] **Date of Patent: *Oct. 13, 1998**

[54] EARTH-BORING BIT WITH IMPROVED CUTTING STRUCTURE

[75] Inventors: Danny Eugene Scott; Rudolf Carl Otto Pessier, both of Houston, Tex.

[73] Assignee: Baker Hughes Incorporated, Houston, Tex.

[ * ] Notice: The term of this patent shall not extend beyond the expiration date of Pat. No. 5,542,485.

[21] Appl. No.: 689,404

[22] Filed: Aug. 6, 1996

Related U.S. Application Data

[63] Continuation-in-part of Ser. No. 373,149, Jan. 17, 1995, Pat. No. 5,542,485, which is a continuation-in-part of Ser. No. 293,228, Aug. 18, 1994, Pat. No. 5,479,997, which is a continuation of Ser. No. 89,318, Jul. 8, 1993, Pat. No. 5,351,798.

[51] Int. Cl.[6] ..... E21B 10/16

[52] U.S. Cl. ..... 175/371; 175/374

[58] Field of Search ..... 175/331, 371, 175/374, 379, 426, 431

[56] References Cited

U.S. PATENT DOCUMENTS

| | | | |
|---|---|---|---|
| 3,452,831 | 7/1969 | Beyer . | |
| 5,201,376 | 4/1993 | Williams | 175/374 |
| 5,287,936 | 2/1994 | Grimes et al. . | |
| 5,351,768 | 10/1994 | Scott et al. | 175/374 |
| 5,353,885 | 10/1994 | Hooper et al. | 175/374 X |
| 5,479,997 | 1/1996 | Scott et al. | 175/374 |
| 5,542,485 | 8/1996 | Pessier et al. | 175/374 |
| 5,544,713 | 8/1996 | Dennis . | |

FOREIGN PATENT DOCUMENTS

| | | |
|---|---|---|
| 0-467-870-A1 | 1/1992 | European Pat. Off. . |
| 0-511-547-A2 | 11/1992 | European Pat. Off. . |

*Primary Examiner*—William P. Neuder
*Attorney, Agent, or Firm*—James E. Bradley

[57] ABSTRACT

An earth-boring bit has a bit body and at least one cutter rotatably secured to the bit body. The cutter has a cutter shell surface including a gage surface and a heel surface. A plurality of cutting elements inserts are arranged in generally circumferential rows on the cutter. At least one scraper cutting element is secured at least partially to the heel surface of the cutter. The scraper cutting element includes an outermost surface, generally aligned with the gage surface of the cutter, that defines a plow edge or point for shearing engagement with the sidewall of the borehole while redirecting cuttings up the borehole.

24 Claims, 9 Drawing Sheets

EARTH-BORING BIT WITH IMPROVED CUTTING STRUCTURE

RELATED APPLICATION

This application is a continuation-in-part of application Ser. No. 08/373,149, filed Jan. 17, 1995 now U.S. Pat. No. 5,542,485, Aug. 6, 1996, which is a continuation-in-part of application Ser. No. 08/293,228, filed Aug. 18, 1994, now U.S. Pat. No. 5,479,997, Jan. 2, 1996, which is a continuation of application Ser. No. 08/089,318, filed Jul. 8, 1993, now U.S. Pat. No. 5,351,798, Oct. 4, 1994.

BACKGROUND OF THE INVENTION

1. Field of the Invention

The present invention generally relates to earth-boring drill bits. More particularly, the present invention relates to improved cutting structures or geometries for earth-boring drill bits.

2. Background Information

The success of rotary drilling enabled the discovery of deep oil and gas reservoirs. The rotary rock bit was an important invention that made the success of rotary drilling possible. Only soft earthen formations could be penetrated commercially with the earlier drag bit, but the two-cone rock bit, invented by Howard R. Hughes, U.S. Pat. No. 930,759, drilled the caprock at the Spindletop field, near Beaumont, Texas with relative ease. That venerable invention within the first decade of this century could drill a scant fraction of the depth and speed of the modern rotary rock bit. The original Hughes bit drilled for hours, the modern bit drills for days. Modern bits sometimes drill for thousands of feet instead of merely a few feet. Many advances have contributed to the impressive improvements in rotary rock bits.

In drilling boreholes in earthen formations by the rotary method, rotary rock bits having one, two, or three rolling cutters rotatably mounted thereon are employed. The bit is secured to the lower end of a drillstring that is rotated from the surface or by downhole motors or turbines. The cutters mounted on the bit roll and slide upon the bottom of the borehole as the drillstring is rotated, thereby engaging and disintegrating the formation material to be removed. The roller cutters are provided with teeth that are forced to penetrate and gouge the bottom of the borehole by weight from the drillstring.

The cuttings from the bottom and sides of the borehole are washed away by drilling fluid that is pumped down from the surface through the hollow rotating drillstring, and are carried in suspension in the drilling fluid to the surface. The form and location of the teeth or inserts upon the cutters have been found to be extremely important to the successful operation of the bit. Certain aspects of the design of the cutters becomes particularly important if the bit is to penetrate deep into a formation to effectively strain and induce failure in the formation material.

The current trend in rolling cutter earth-boring bit design is toward coarser, more aggressive cutting structures or geometries with widely spaced teeth or inserts. These widely spaced teeth prevent balling and increase bit speed through relatively soft, low compressive strength formation materials such as shales and siltstones. However, large spacing of heel teeth or inserts permits the development of large "rock ribs," which originate in the corner and extend up the wall of the borehole. In softer, low compressive strength formations, these rock ribs form less frequently and do not pose a serious threat to bit performance because they are disintegrated easily by the deep, aggressive cutting action of even the widely spaced teeth or inserts.

In hard, high compressive strength, tough, and abrasive formation materials, such as limestones, dolomites and sandstones, the formation of rock ribs can affect bit performance seriously, because the rock ribs are not destroyed easily by conventional cutter action due to their inherent toughness and high strength. Because of the strength of these materials, tooth or insert penetration is reduced, and the rock ribs are not as easily disintegrated as in the softer formation materials. Rock ribs formed in high compressive strength, abrasive formation materials can become quite large, causing the cutter to ride up on the ribs and robbing the teeth or inserts of the unit load necessary to accomplish effective penetration and crushing of formation material.

Maintenance of the gage or diameter of the borehole and reduction of cutter shell erosion in hard, tough, and abrasive formations is more critical with the widely spaced tooth type of cutting structure, because fewer teeth or inserts are in contact with the borehole bottom and sidewall, and more of the less abrasion-resistant cutter shell surface can come into contact with the borehole bottom and sidewall. Rock ribs can contact and erode the cutter shell surface around and in between heel and gage inserts, sometimes enough to cause insert loss. Additionally, wear may progress into the shirttails of the bit, which protect the bearing seals, leading to decreased bearing life.

Provision of cutters with more closely spaced teeth or inserts reduces the size of rock ribs in hard, tough, and abrasive formations, but leads to balling, or clogging of cutting structure, in the softer formation materials. Furthermore, the presence of a multiplicity of closely spaced teeth or inserts reduces the unit load on each individual tooth and slows the rate of penetration of the softer formations.

As heel inserts wear, they become blunted and more of the cutter shell surface is exposed to erosion. Extensive cutter shell erosion leads to a condition called "rounded gage." In the rounded gage condition, both the heel inserts and the cutter shell surface wear to conform generally to the contours of the corner of the borehole, and the gage inserts are forced to bear the entire burden of maintaining a minimum borehole diameter or gage. Both of these occurrences generate undesirable increase in lateral forces on the cutter, which lower penetration rates and accelerate wear on the cutter bearing and subsequent bit failure.

One way to minimize cutter shell erosion is to provide small, flat-topped compacts in the heel surface of the cutter alternately positioned between heel inserts, as disclosed in U.S. Pat. No. 3,952,815, Apr. 27, 1976, to Dysart. However, such flat-topped inserts do not inhibit the formation of rock ribs. The flat-topped inserts also permit the gage inserts to bear an undesirable proportion of the burden of maintaining minimum gage diameter.

U.S. Pat. No. 2,804,242, Aug. 27, 1957, to Spengler, discloses gage shaving teeth alternately positioned between heel teeth, the shaving teeth having outer shaving surfaces in the same plane as the outer edges of the heel teeth to shave the sidewall of the borehole during drilling operation. The shaving teeth are preferably one-half the height of the heel teeth, and thus function essentially as part of the primary heel cutting structure. In the rounded condition, the shaving teeth conform to the corner of the borehole, reducing the unit load on the heel teeth and their ability to penetrate and disintegrate formation material. The shaving teeth disclosed by Spengler are generally fragile and thus subject to accelerated wear and rapid rounding, exerting the undesirable increased lateral forces on the cutter discussed above.

A need exists, therefore, for an earth-boring bit having an improved ability to maintain an efficient cutting geometry as the bit encounters both hard, high-strength, tough and abrasive formation materials and soft, low-strength formation materials and as the bit wears during drilling operation.

SUMMARY OF THE INVENTION

A principal object of the present invention is to provide an earth-boring bit having an improved ability to maintain an efficient cutting geometry or structure as the earth-boring bit alternately encounters hard and soft formation materials and as the bit wears during drilling operation in borehole.

This and other objects of the present invention are achieved by providing an earth-boring bit having a bit body and at least one cutter rotatably secured to the bit body. The cutter has a cutter shell surface including a gage surface and a heel surface. A plurality of cutting elements inserts are arranged in generally circumferential rows on the cutter. At least one scraper cutting element is secured at least partially to the heel surface of the cutter. The scraper cutting element includes an outermost surface, generally aligned with the gage surface of the cutter, that defines a plow edge or point for shearing engagement with the sidewall of the borehole while redirecting cuttings up the borehole.

According to the preferred embodiment of the present invention, an outermost surface of the chisel-shaped insert is generally aligned with and projects beyond the gage surface. Alternatively, the outermost surface is relieved between about three and 15 degrees from the borehole wall.

Other objects, features, and advantages of the present invention will be apparent with reference to the figures and detailed description of the preferred embodiment, which follow.

DESCRIPTION OF THE PREFERRED EMBODIMENT

Figure 1:
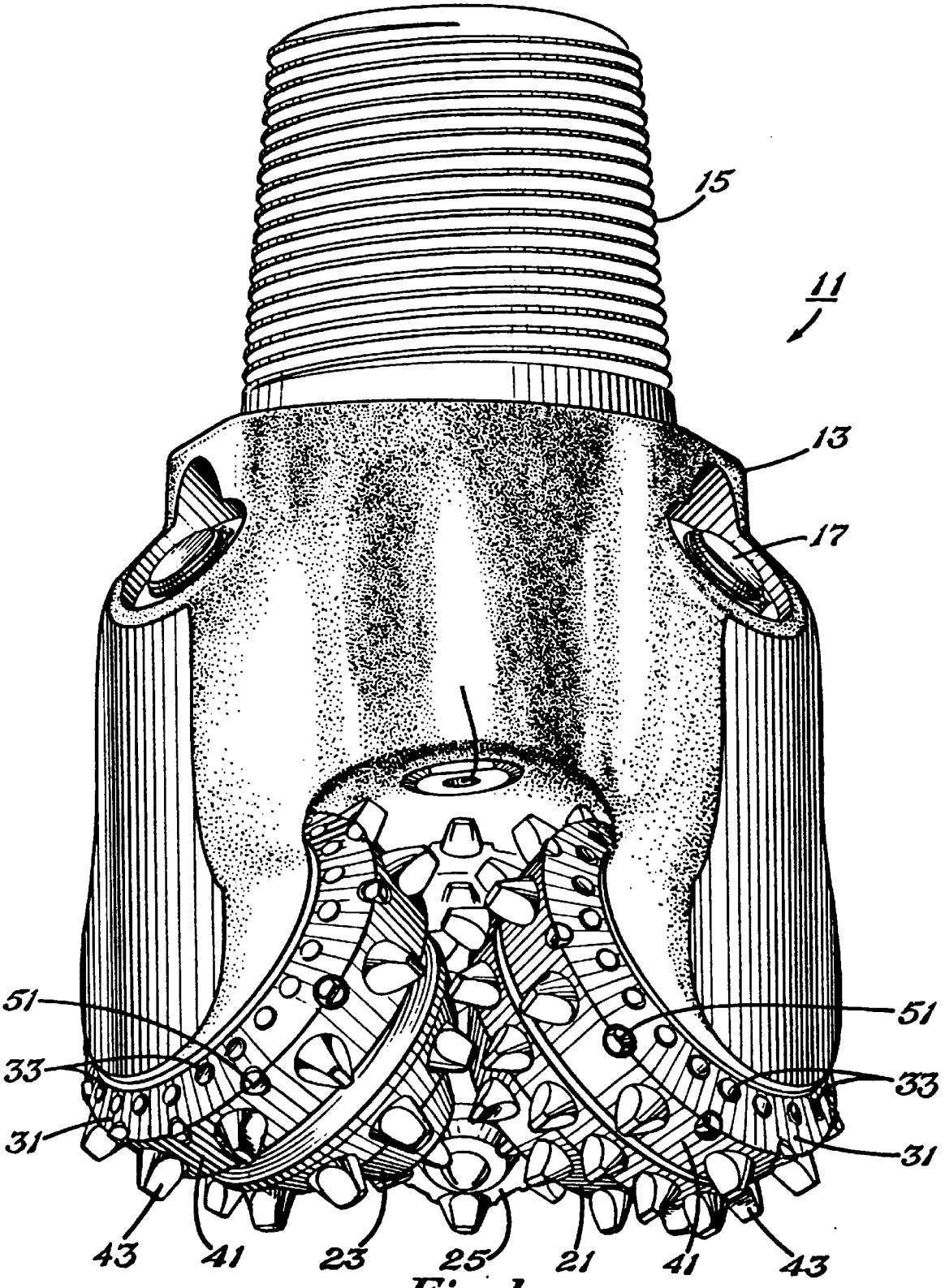
FIG. 1 is a perspective view of an earth-boring bit according to the present invention.

Referring now to FIG. 1, an earth-boring bit 11 according to the present invention is illustrated. Bit 11 includes a bit body 13, which is threaded at its upper extent 15 for connection into a drillstring. Each leg of bit 11 is provided with a lubricant compensator 17, a preferred embodiment of which is disclosed in U.S. Pat. No. 4,276,946, Jul. 7, 1981, to Millsapps. At least one nozzle 19 is provided in bit body 13 to spray drilling fluid from within the drillstring to cool and lubricate bit 11 during drilling operation. Three cutters 21, 23, 25 are rotatably secured to each leg of bit body 13. Each cutter 21, 23, 25 has a cutter shell surface including a gage surface 31 and a heel surface 41.

A plurality of cutting elements, in the form of hard metal inserts, are arranged in generally circumferential rows on each cutter. Each cutter 21, 23, 25 has a gage surface 31 with a row of gage elements 33 thereon. A heel surface 41 intersects each gage surface 31 and has at least one row of heel cutting elements 43 thereon.

At least one scraper element 51 is secured to the cutter shell surface at the intersection of or generally circular juncture between gage and heel surfaces 31, 41 and generally intermediate a pair of heel cutting elements 43. Preferably, a scraper cutting element 51 is located between each heel cutting element 43, in an alternating arrangement. As is more clearly illustrated in FIGS. 4–5B, scraper element 51 comprises a generally cylindrical body 53, which is adapted to be received in an aperture in the cutter shell surface at the intersection of gage and heel surfaces 31, 41.

Preferably, scraper element 51 is secured within the aperture by an interference fit. Extending upwardly from generally cylindrical body 53 are a pair of element surfaces 55, 57, which converge to define a cutting edge 59. Preferably, cutting edge 59 is oriented circumferentially, i.e., normal to the axis of rotation of each cutter 21, 23, 25.

Figure 3A:
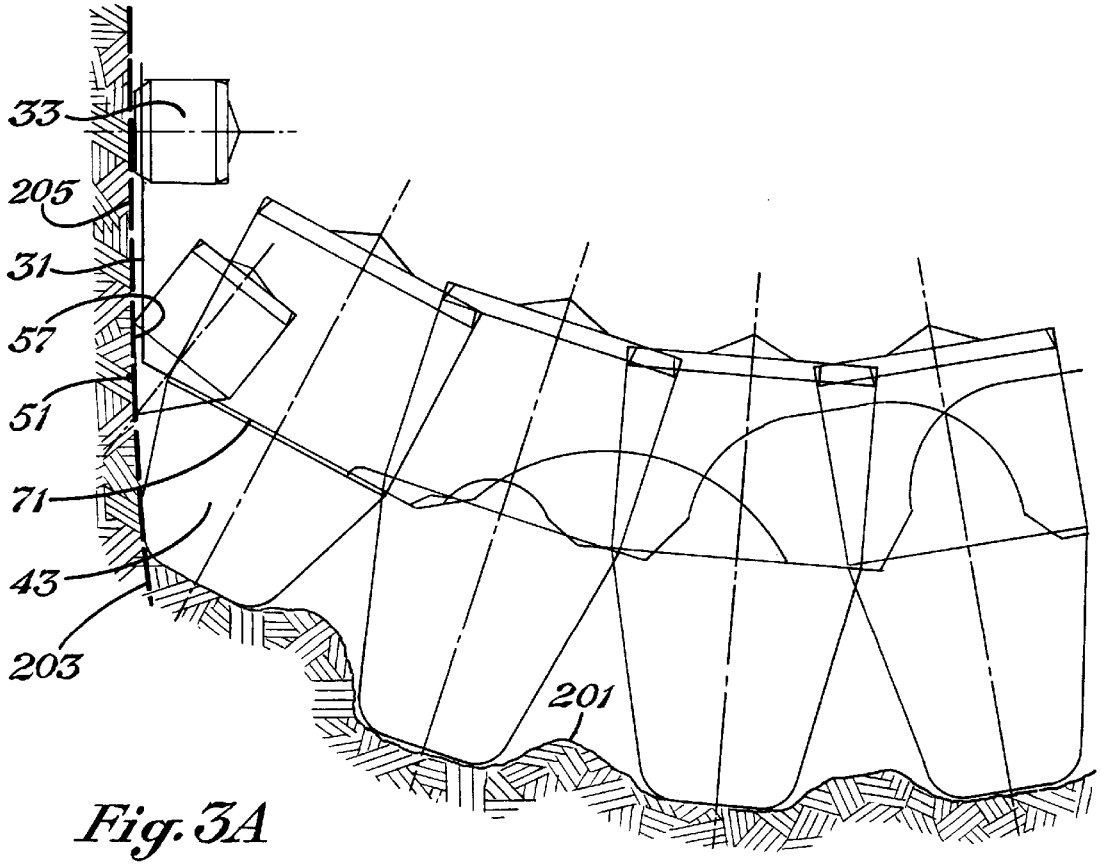
FIGS. 3A through 3C are fragmentary, longitudinal section views of the progressive wear of an earth-boring bit according to the present invention.
Figure 3B:
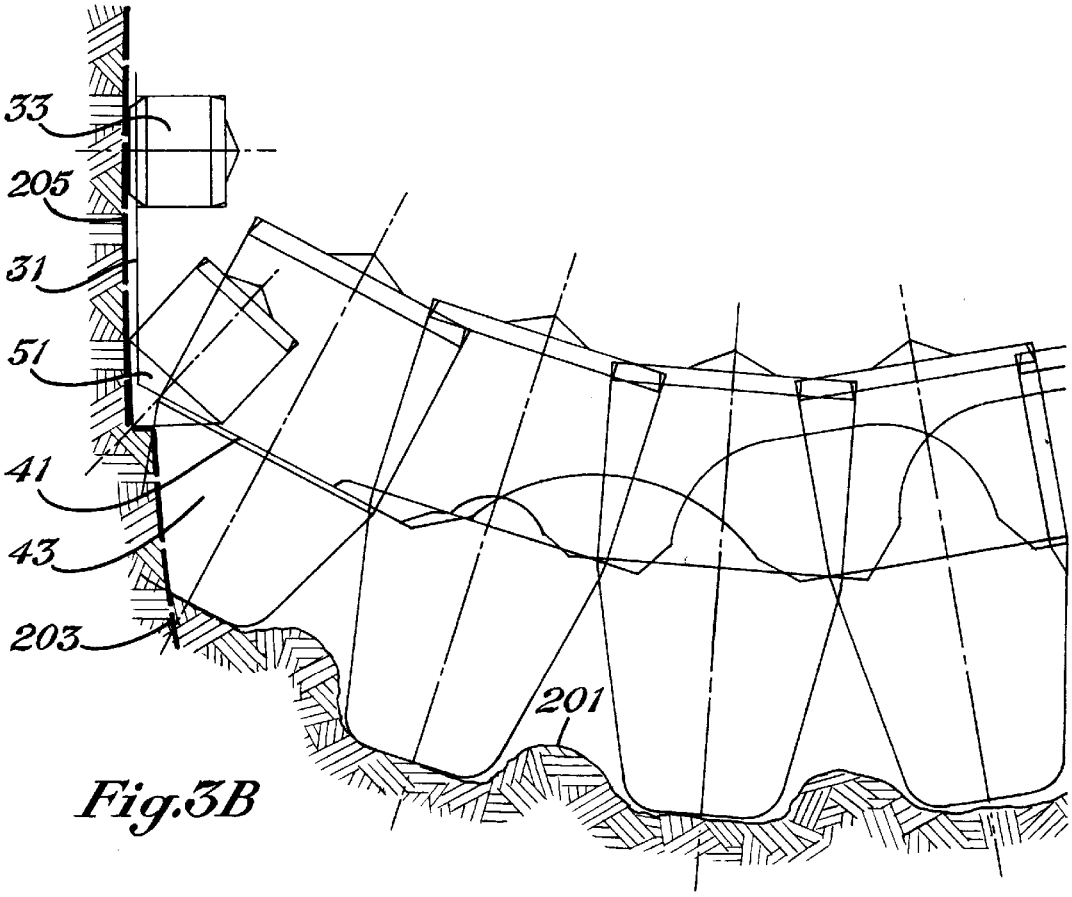
Figure 3C:
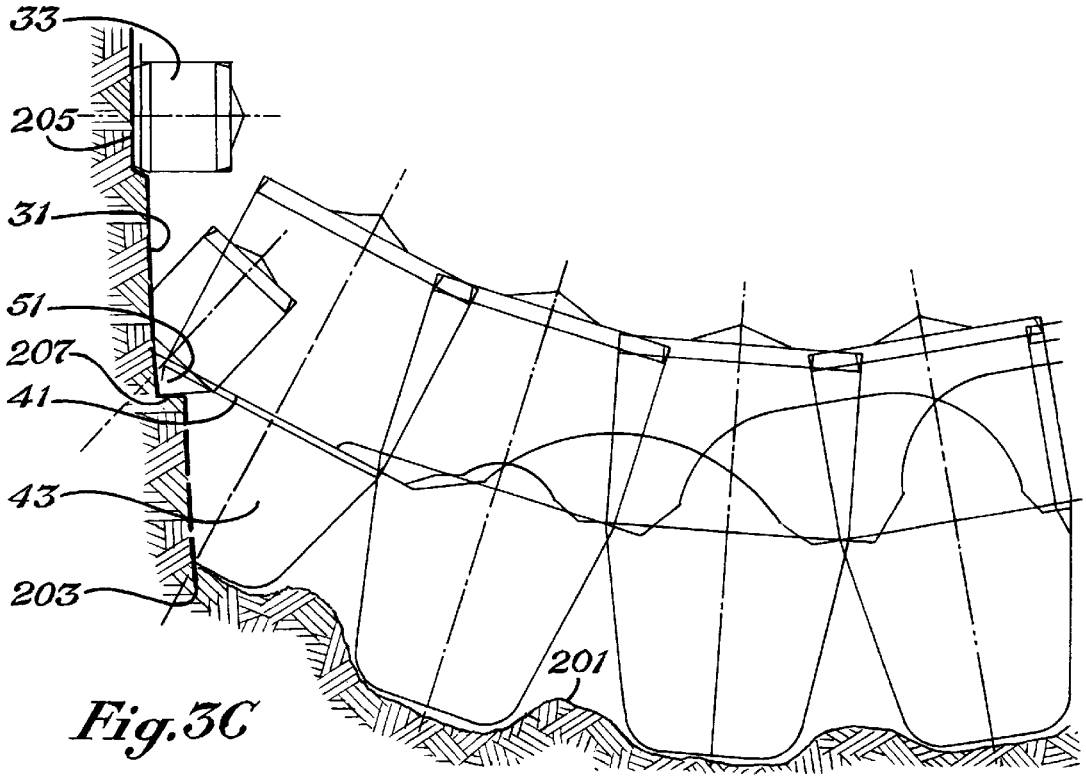

As is more clearly depicted in FIGS. 3A–3C, scraper cutting element is secured to the cutter shell surface such that one of scraper surfaces 55, 57 defines a gage element surface that extends generally parallel to the sidewall (205 in FIG. 3A) of the borehole. Another of scraper element surfaces 55, 57 defines a heel element surface.

Figure 4:
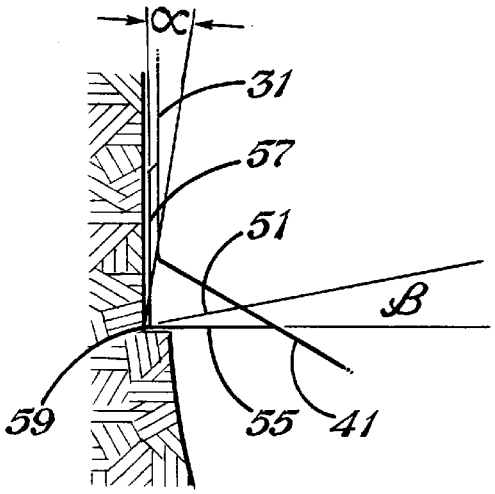
FIG. 4 is an enlarged view of a scraper cutting element in contact with the sidewall of the borehole.

As depicted in FIG. 4, scraper cutting element 51 is oriented such that gage scraper surface 57 is generally aligned with and projects beyond gage surface 31. It is contemplated that surface 57 may be relieved away from the sidewall of the borehole a clearance angle a between three and 15 degrees. Relieving surface 57 decreases engagement between scraper cutting element 51 and the sidewall of the borehole, which may reduce the ability of scraper 51 to protect gage surface 31 against abrasive wear. However, it is believed that the reduction in frictional engagement between scraper 51 and the sidewall more than compensates for the reduction in abrasion resistance.

Figure 2A:
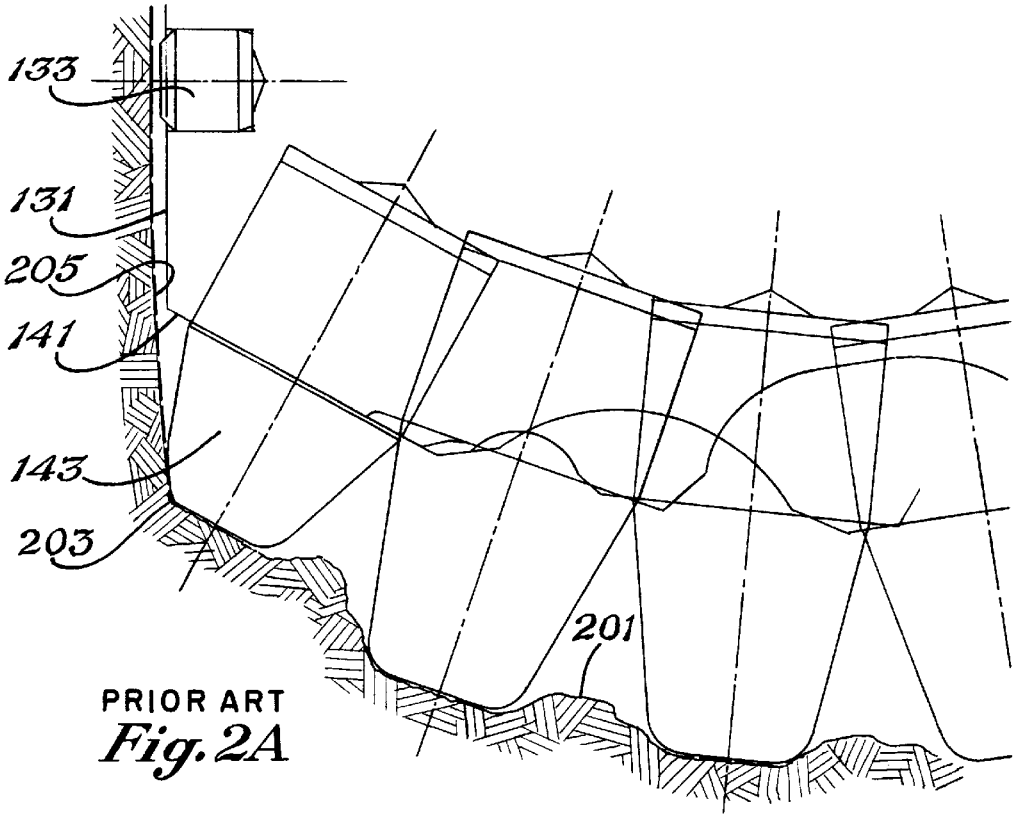
PRIOR ART Fig. 2A
FIGS. 2A through 2C are fragmentary, longitudinal section views showing progressive wear of a prior-art earth-boring bit.
Figure 2B:
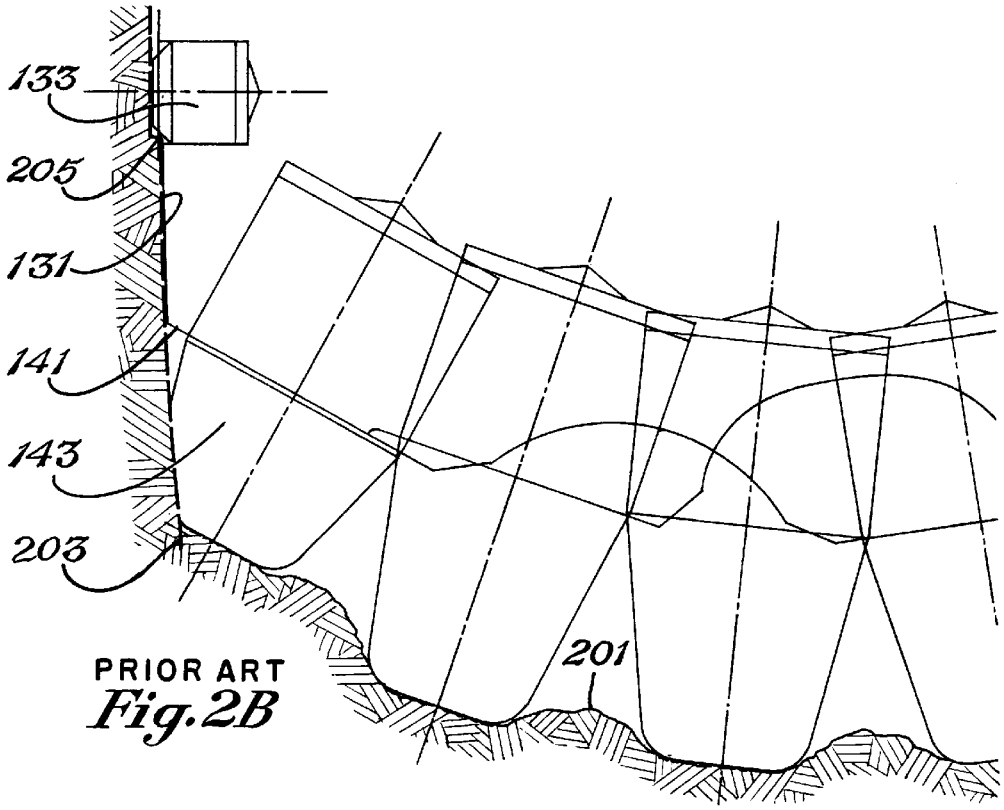
PRIOR ART Fig. 2B

FIGS. 2A–2B are fragmentary, longitudinal section views of the cutting geometry of a prior-art earth-boring bit, showing progressive wear from a new condition to the "rounded gage" condition. The reference numerals in FIGS. 2A–2C that begin with the numeral 1 point out structure that is analogous to that illustrated in earth-boring bit 11 according to the present invention depicted in FIG. 1, e.g., heel tooth or cutting element 143 in FIG. 2A is analogous to heel cutting element 43 depicted in FIG. 1, heel surface 141 in FIG. 2A is analogous to heel surface 41 depicted in FIG. 1, etc.

FIG. 2A depicts a prior-art earth-boring bit in a borehole. FIG. 2A depicts the prior-art earth-boring bit in a new or unworn condition, in which the intersection between gage and heel surfaces 131, 141 is prominent and does not contact sidewall 205 of borehole. The majority of the teeth or cutting elements engage the bottom 201 of the borehole. Heel teeth or elements 143 engage corner 203 of the borehole, which is generally defined at the intersection of sidewall 205 and bottom 201 of borehole. Gage element 133 does not yet engage sidewall 205 of the borehole to trim the sidewall and maintain the minimum gage diameter of the borehole.

FIG. 2B depicts the prior-art earth-boring bit of FIG. 2A in a moderately worn condition. In the moderately worn condition, the outer end of heel tooth or element 143 is abrasively worn, as is the intersection of gage and heel surfaces 131, 141. Abrasive erosion of heel tooth or element 143 and gage and heel surfaces 131, 141 of cutter shell causes the earth-boring bit to conform with corner 203 and sidewall 205 of the borehole. Thus, gage element 133 cuts into sidewall 205 of the borehole to maintain gage diameter in the absence of heel inserts' 143 ability to do so. sidewall of borehole 205 is in constant conforming contact with the cutter shell surface, generally at what remains of the intersection between gage and heel surfaces 131, 141. These two conditions cause the cutters of the prior-art earth-boring bit to be increasingly laterally loaded, which accelerates bearing wear and subsequent bit failure.

Figure 2C:
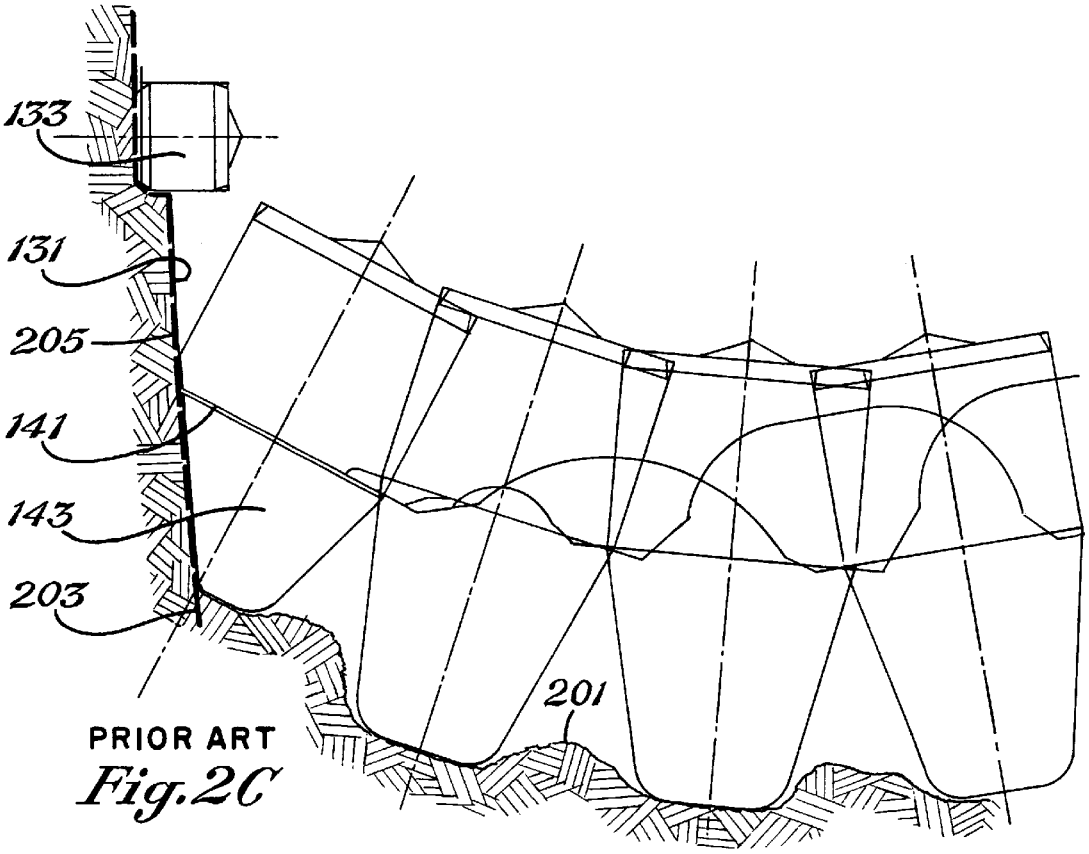
PRIOR ART Fig. 2C

FIG. 2C illustrates the prior-art earth-boring bit of FIGS. 2A and 2B in a severely worn, or rounded gage, condition. In this rounded gage condition, the outer end of heel tooth or element 143 is severely worn, as is the cutter shell surface generally in the area of the intersection of gage and heel surfaces 131, 141. Moreover, because severely worn heel tooth or element 143 is now incapable of cutting and trimming sidewall of 205 of the wellbore to gage diameter, gage element 133 excessively penetrates sidewall 205 of the borehole and bears the bulk of the burden in maintaining gage, a condition for which gage element 133 is not optimally designed, thus resulting in inefficient gage cutting and lower rates of penetration. Thus, the conformity of the cutter shell surface with corner 203 and sidewall 205 of the borehole, along with excessive penetration of sidewall 205 of the borehole by gage element 133, are exaggerated over that shown in the moderately worn condition of FIG. 2B. Likewise, the excessive lateral loads and inefficient gage cutting also are exaggerated. Furthermore, excessive erosion of the cutter shell surface may result in loss of either gage element 133 or heel element 143, clearly resulting in a reduction of cutting efficiency.

FIGS. 3A–3C are fragmentary, longitudinal section views of earth-boring bit 11 according to the present invention as it progressively wears in a borehole. FIG. 3A illustrates earth-boring bit 11 in a new or unworn condition, wherein the majority of the teeth or elements engage bottom 201 of the borehole. Heel elements or teeth 43 engage corner 203 of the borehole. As more clearly illustrated in FIG. 4, one of scraper element surfaces 57 defines a gage element surface 57 that extends generally parallel to sidewall 205 of the borehole. Another of scraper element surfaces 55, 57 defines a heel element surface 55 that defines a negative rake angle β with respect to sidewall 205 of the borehole.

Scraper element 51 is constructed of a material having greater wear-resistance than at least gage and heel surfaces 31, 41 of the cutter shell surface. Thus, the gage element surface of scraper element 51 protects gage surface 31 from severe abrasive erosion resulting from contact with sidewall 205 of the borehole. Likewise, the heel element surface of scraper element 51 protects heel surface 41 from abrasive erosion resulting from contact with corner 203 of the borehole. Scraper element 51 also inhibits formation of rock ribs between adjacent heel cutting elements 43. Cutting edge 59 creates a secondary corner 207 and kerfs nascent rock ribs, disintegrating them before they can detract from efficient drilling.

FIG. 3B depicts earth-boring bit 11 in a moderately worn condition in which the outer end of heel tooth or element 43 is worn. However, scraper element 51 has prevented a great deal of the cutter shell erosion at the intersection of gage and heel surfaces 31, 41, and still functions to form a the secondary corner, thereby maintaining a clearance between gage element 33 and sidewall 205 of the borehole, and avoiding conformity. Thus, the presence of scraper element 51 promotes cutting efficiency and deters rapid abrasive erosion of the cutter shell surface.

FIG. 3C illustrates earth-boring bit 11 according to the present invention in a severely worn condition in which the outer end of heel tooth or element 43 is severely worn and the cutter shell surface is only moderately eroded. By preventing excessive cutter erosion, conformity of the cutter shell surface with sidewall 205 of the borehole is greatly reduced, along with the attendant increased lateral loads on cutters 21, 23, 25 and inefficient cutting by gage element 33. Only in this most severely worn condition, where heel elements 43 are extremely worn, do gage elements 33 actively cut sidewall 205 of borehole.

Figure 5A:
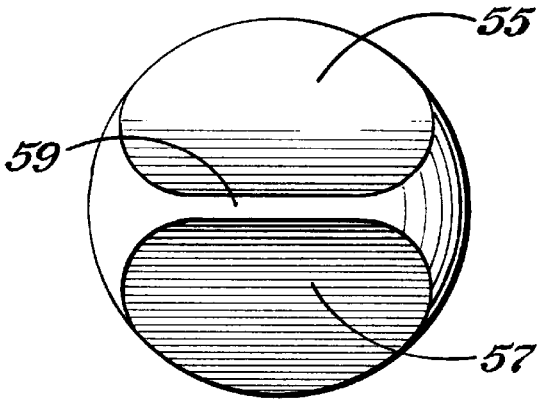
FIGS. 5A and 5B are plan and side elevation views, respectively, of the preferred scraper cutting element of FIG. 4.
Figure 5B:
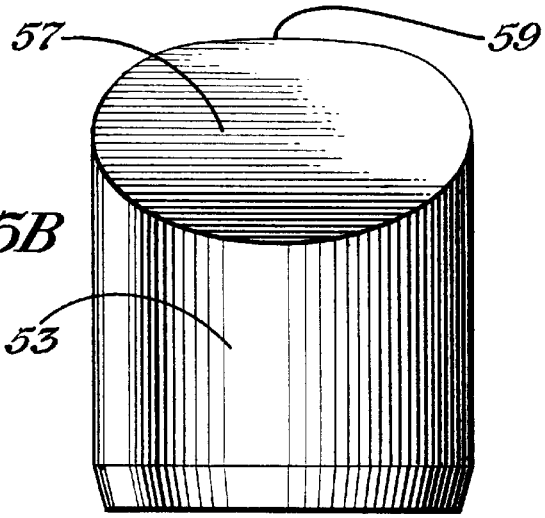

FIGS. 5A and 5B are enlarged elevation and plan views of a preferred scraper element 51 according to the present invention. Scraper element 51 is formed of a hard metal such as cemented tungsten carbide or similar material having high hardness and abrasion-resistance. As stated before, upon installation of scraper element 51 by interference fit in an aperture generally at the intersection of gage and heel surfaces 31, 41, one of scraper element surfaces 55, 57 will define a gage element surface, and the other of scraper element surfaces 55, 57 will define a heel element surface. The gage element and heel element surfaces 55, 57 converge at a right angle to define a circumferentially oriented cutting edge 59 for engagement with sidewall 205 of the borehole. Preferably, the radius or width of cutting edge 59 is less than or equal to the depth of penetration of cutting edge 59 into formation material of the borehole as bit 11 wears or rock ribs form.

Efficient cutting by scraper element 51 requires maintenance of a sharp cutting edge 59. Accordingly, one of scraper element surfaces 55, 57 preferably is formed of a more wear-resistant material than the other of surfaces 55, 57. The differential rates of wear of surfaces 55, 57 results in a self-sharpening scraper element 51 that is capable of maintaining a sharp cutting edge 59 over the drilling life of earth-boring bit 11. The more wear-resistant of scraper elements surfaces 55, 57 may be formed of a different grade or composition of hard metal than the other, or could be formed of an entirely different material such as polycrystalline diamond or the like, the remainder of the element being a conventional hard metal. In any case, scraper element 51 should be formed of a material having a greater wear-resistance than the material of the cutter shell surface, which is usually steel, so that scraper element 51 can effectively prevent erosion of the cutter shell surface at the intersection of gage and heel surfaces 31, 41.

In addition to, and perhaps more important than its protective function, scraper element 51 serves as a secondary cutting structure. The cutting structure is described as "secondary" to distinguish it from primary cutting structure such as heel elements 43, which have the primary function of penetrating formation material to crush and disintegrate the material as cutters 21, 23, 25 roll and slide over the bottom of the borehole.

As described above, bits 11 having widely spaced teeth are designed to achieve high rates of penetration in soft, low compressive strength formation materials such as shale. Such a bit 11, however, is expected to encounter hard, tough, and abrasive streaks of formation material such as limestones, dolomites, or sandstones. Addition of primary cutting structure, like heel elements 43 or the inner row inserts, assists in penetration of these hard, abrasive materials and helps prevent cutter shell erosion. But, this additional primary cutting structure reduces the unit load on each tooth or insert, drastically reducing the rate of penetration of bit 11 through the soft material it is designed to drill.

To insure that scraper element 51 functions only as secondary cutting structure, engaging formation material only when heel elements 43 are worn, or when large rock ribs form while drilling a hard, abrasive interval, the amount of projection of cutting edge 59 from heel surface 41 must be kept within certain limits. Clearly, to avoid becoming primary structure, cutting edge 59 must not project beyond heel surface 41 more than one-half the projection of heel element 43. Further, to insure that scraper element 51 engages formation material only when large rock ribs form, the projection of cutting edge 59 must be less than 30% of the pitch between the pair of heel teeth that scraper element 51 is secured between. Pitch describes the distance or spacing between two teeth in the same row of an earth-boring bit. Pitch, in this case, is measured as the center-to-center linear distance between the crests of any two adjacent teeth in the same row.

Figure 6:
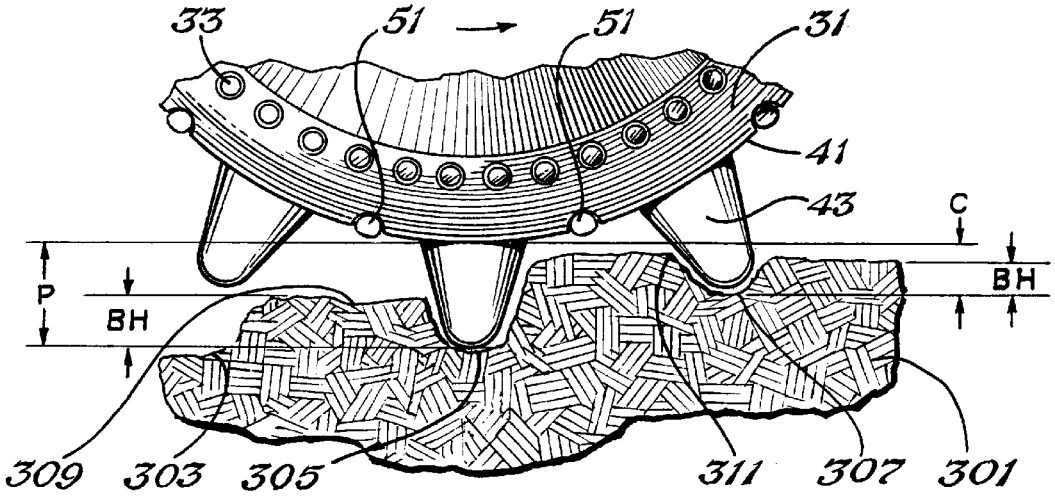
FIG. 6 is a fragmentary section view of a portion of the earth-boring bit according to the present invention in operation in a borehole.

The importance of this limitation becomes apparent with reference to FIG. 6, which depicts a fragmentary view of a portion of an earth-boring bit 11 according to the present invention operating in a borehole. FIG. 6 illustrates the manner in which heel elements 43 penetrate and disintegrate formation material 301. Heel teeth 43 make a series of impressions 303, 305, 307 in formation material 301. By necessity, there are buildups 309, 311 between each impression. Buildups 309, 311 are expected in most drilling, but in drilling hard, abrasive formations with bits having large-pitch, or widely spaced, heel elements 43, these buildups can become large enough to detract from bit performance by engaging the cutter shell surface and reducing the unit load on each heel element 43.

Projection P of heel elements 43 from heel surface provides a datum plane for reference purposes because it naturally governs the maximum penetration distance of heel elements 43. Buildup height BH is measured relative to each impression 303, 305, 307 as the distance from the upper surface of the buildup to the bottom of each impression 303, 305, 307. Cutter shell clearance C is the distance between the heel surface 41 and the upper surface of the buildup of interest. As stated above, it is most advantageous that clearance C be greater than zero in hard, tough, and abrasive formations. It has been determined that buildup height BH is a function of pitch and generally does not exceed approximately 30% of the pitch of heel elements 43, at which point clearance C is zero and as a reduction in unit load on heel elements 43 and cutter erosion occur.

Thus, to avoid functioning as a primary cutting structure, scraper element 51 should not engage formation material until buildup 309 begins to enlarge into a rock rib or the depth of cut approaches projection P of heel elements 43, wherein clearance C approaches zero. This is accomplished by limiting the projection of cutting edge 59 from heel surface 41 to an amount less than 30% of the pitch of the pair of heel elements 43 between which scraper element 51 is secured.

For example, for a 12¼ inch bit having a pitch between two heel elements 43 of 2 inches, and heel elements 43 having a projection P of 0.609 inch, scraper elements 51 have a projection of 0.188 inch, which is less than one-half (0.305 inch) projection P of heel elements 43 and 30% of pitch, which is 0.60 inch. In the case of extremely large heel pitches, i.e. greater than 2 inches, it may be advantageous to place more than one scraper element 51 between heel elements 43.

Figure 7:
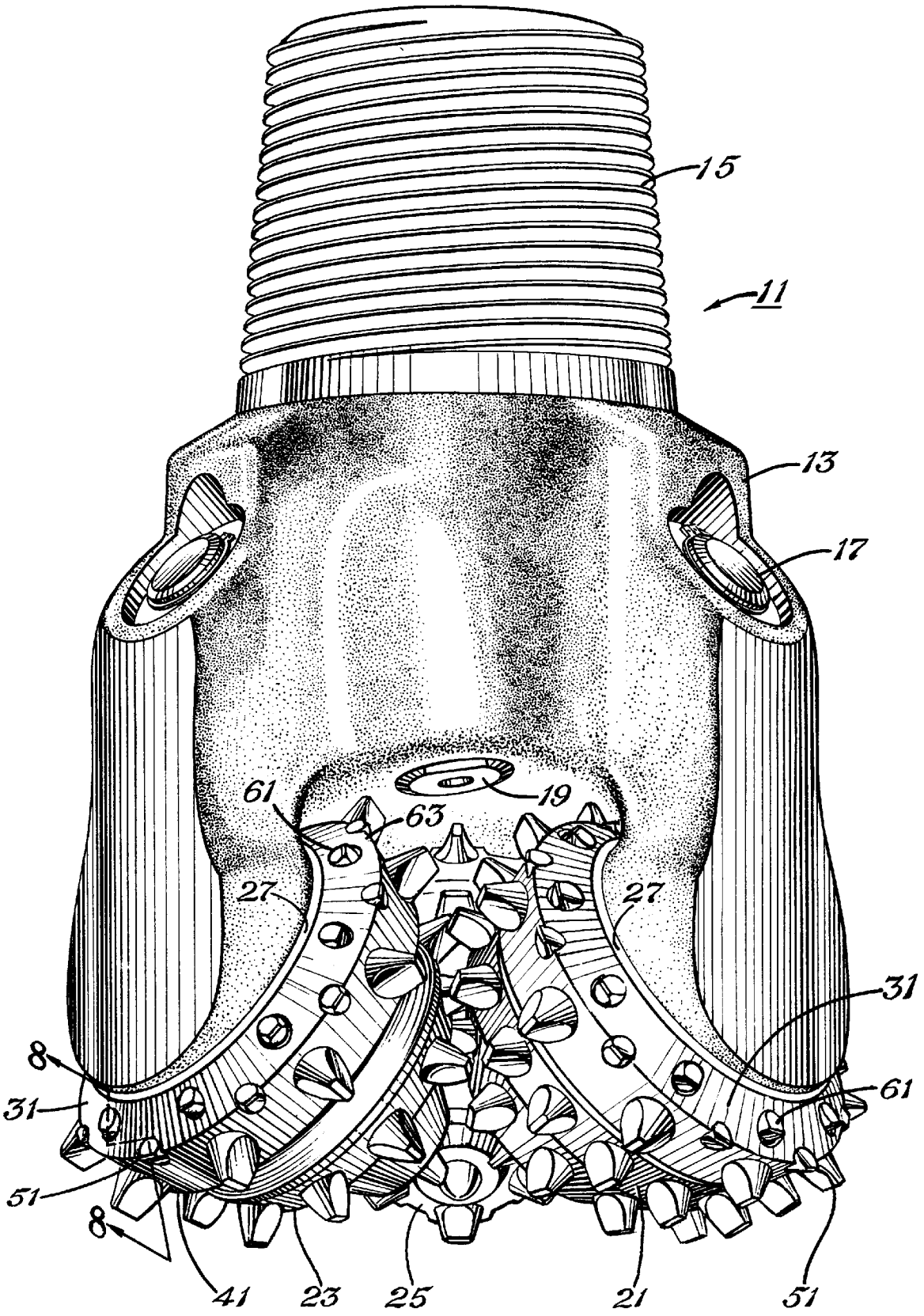
FIG. 7 is a perspective view of an earth-boring bit according to the present invention.

FIG. 7 is a perspective view of an earth-boring bit 11 according to the preferred embodiment of the present invention. Bit 11 is generally similar to that described in connection with FIG. 1, but with the addition of a row of chisel-shaped cutting elements 61 secured to gage surface 31 of each cutter 21, 23, 25. As is seen, each chisel-shaped cutting element 61 is formed similarly to scraper element 51 described above, but is positioned on gage surface 31, rather than at the intersection or generally circular juncture of gage 31 and heel 41 surfaces. Preferably, chisel-shaped cutting elements 61 alternate with scraper cutting elements 51 to provide staggered rows of secondary and tertiary cutting structure.

As described in greater detail with reference to FIG. 8, each chisel-shaped cutting element 61 is surrounded by a generally circular counterbore 63, which serves to provide an area around cutting element 61 that facilitates movement of cuttings and abrasive fines around cutting element 61 and up the borehole. Preferably, chisel-shaped cutting elements 61 are tilted toward heel surface 41 such that they are oriented in the direction of cut or advance of each cutter 21, 23, 25 as it rolls and slides on the bottom of the borehole.

Figure 8:
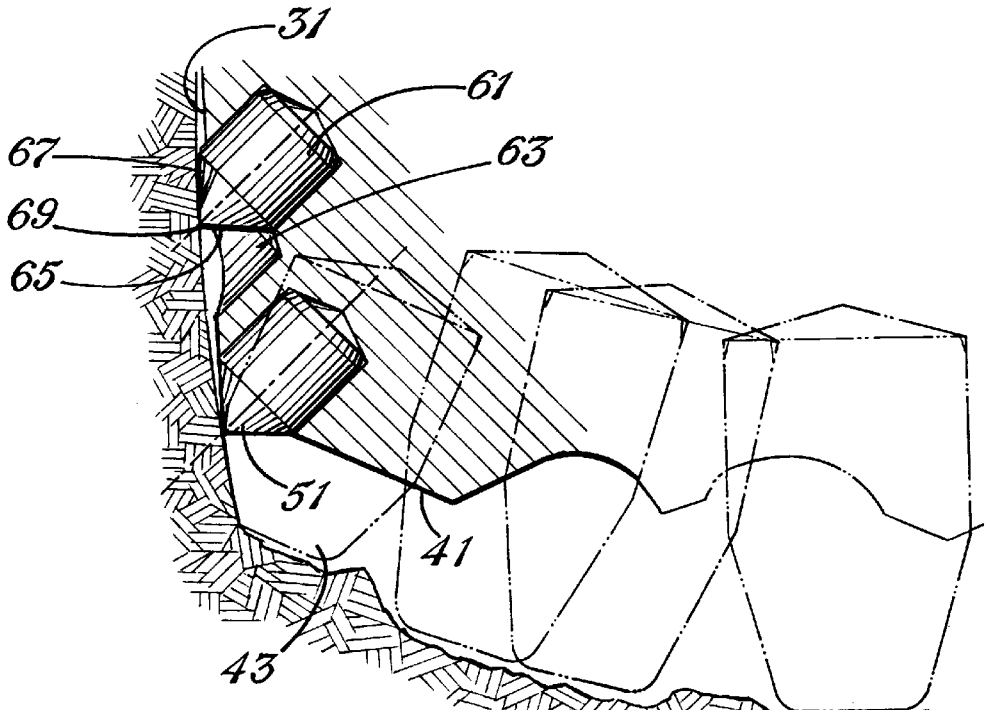
FIG. 8 is a fragmentary section view of the earth-boring bit of FIG. 7, depicting the relationship of the cutting elements of the cutters of the bit on the bottom of the borehole.

FIG. 8 is a fragmentary section view of earth-boring bit 11 of FIG. 7 illustrating the superimposition of the various cutting elements on cutters relative to one another and to the bottom of the borehole. Inner row cutting elements are illustrated in hidden lines to emphasize the secondary cutting structure including scraper 51 and chisel-shaped cutting elements 61. Scraper cutting element 51 is formed and positioned as described above.

Preferably, chisel-shaped cutting elements 61 have a cylindrical base interference fit in apertures in gage surface 31. Chisel-shaped cutting elements 61 are formed similarly to scraper elements 51 and include a pair of surfaces 65, 67 converging to define a cutting edge or crest 69. Surfaces 65, 67 are formed to be self-sharpening as described above with respect to scraper element 51. Crest 69 is oriented circumferentially or transversely to the axis of rotation of cutters 21, 23, 25. Cutting elements 61 and their axes are tilted toward heel surface 41 and away from backface 27 of cutters 21, 23, 25 to orient cutting elements 61 and crests 69 in the direction of advance of cutters 21, 23, 25 as they scrape the wall of the borehole. Cutting elements 61 and crests 69 are tilted such that a line drawn through the centers of cutting elements 61 and their crests 69 define an acute angle of between about 15 and 75 degrees with gage surface 31, preferably 45 degrees, as illustrated.

The cutting mechanics of chisel-shaped cutting elements 61 are similar to those of scraper cutting elements 51, but the cutting action is concentrated on the sidewall of the borehole, rather than at the corner. Chisel-shaped cutting elements 61 thus provide an aggressive tertiary cutting structure on gage surface 31. According to one embodiment of the present invention, an outermost 67 of the surfaces of chisel-shaped element 61 is generally aligned with or parallel to gage surface 31 and projects beyond it. This configuration, in combination with counterbore 63, provides effective scraping of the borehole wall by cutters 21, 23, 25.

Figure 9:
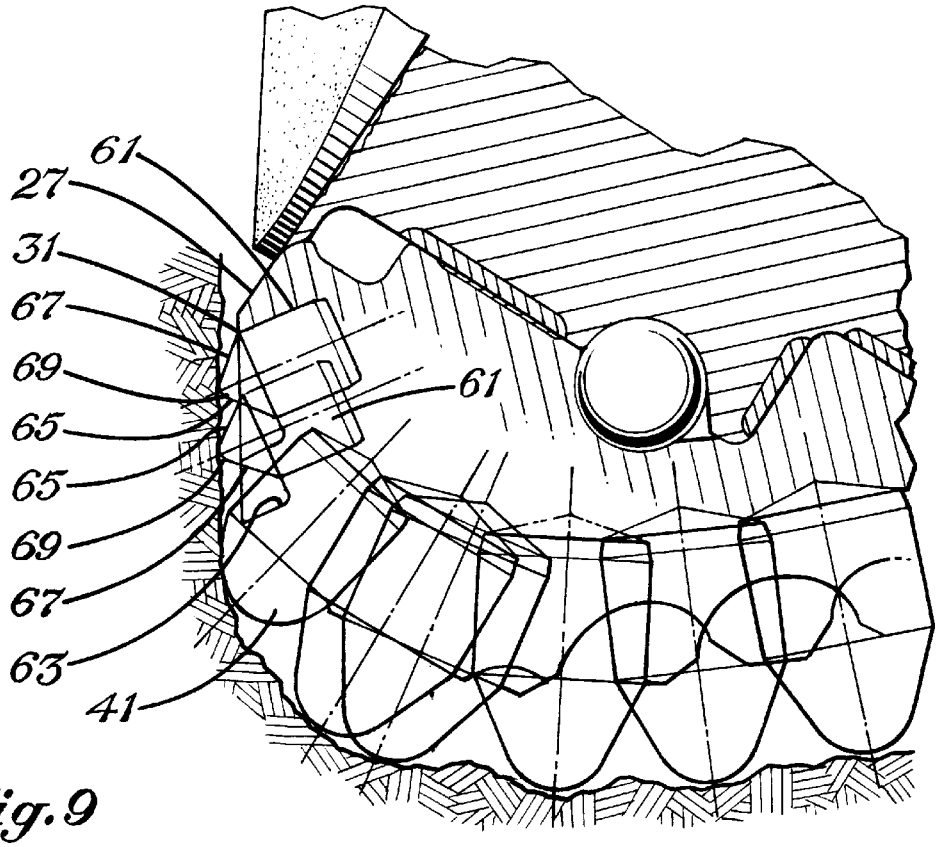
FIG. 9 is a fragmentary section view of an earth-boring bit according to the present invention embodying a variation of the invention illustrated in FIGS. 7 and 8.

FIG. 9 is fragmentary section view, similar to FIG. 8, illustrating a variation of the cutting structure described in connection with FIGS. 7 and 8. In this variation, two rows of chisel-shaped cutting elements 61 are provided on gage surface 31. Each row of chisel-shaped cutting elements is substantially similar to the single row described with reference to FIGS. 7 and 8. However, the second row of chisel-shaped cutting elements is closer to backface 27 of cutters 21, 23, 25, and again provides an aggressive secondary and tertiary cutting structure on gage surface 31. Additionally, outermost surfaces 67 of chisel-shaped cutting elements 61 are relieved between three and 15 degrees from the sidewall of the borehole to minimize frictional engagement therebetween and enhance the aggressiveness of the scraping action.

Figure 10:
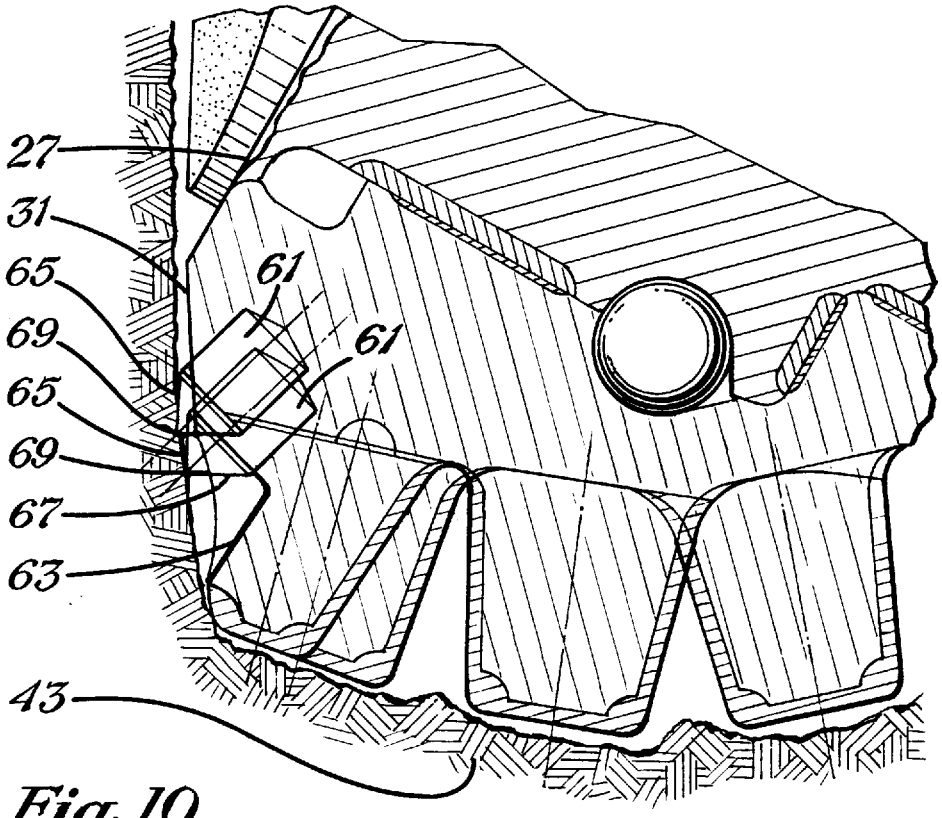
FIG. 10 is a fragmentary section view of a milled- or steel-tooth bit according to the preferred embodiment of the present invention.

FIG. 10 is a fragmentary section view, similar to FIGS. 8 and 9, depicting an arrangement of chisel-shaped cutting elements 61 on a gage surface 31' of a milled- or steel-tooth bit, in which the cutting elements, such as heel teeth 43', are formed of the material of cutters 21, 23, 25 and hard faced to increase their wear resistance. In such a bit, gage surface 31' can be considered to extend from backface 27' of each cutter 21, 23, 25 to nearly the tips of heel teeth 43'.

Chisel-shaped cutting elements 61 again are secured to gage surface 31' and tilted toward heel surface 41' and are surrounded by counterbores 63' to provide clearance for passage of cuttings and abrasive fines around chisel-shaped cutting elements 61. Chisel-shaped cutting elements 61 are arranged in two rows, one being nearer and generally coinciding with the circular juncture between gage 31' and heel 41' surfaces, the other being nearer the cutter backface. In the row nearer the intersection between gage 31' and heel 41' surfaces, counterbore 63 extends into a heel tooth 43'. Like the arrangement illustrated in FIG. 8, the outermost 65 surfaces of chisel-shaped cutting elements 61 are aligned with and project beyond gage surface 31.

Figure 11:
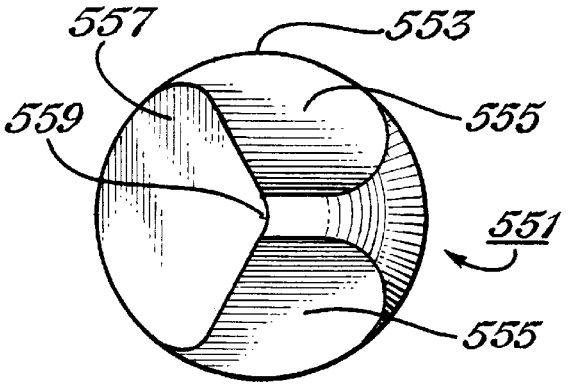
FIG. 11 is a plan view of a cutting element according to the preferred embodiment of the present invention.
Figure 12:
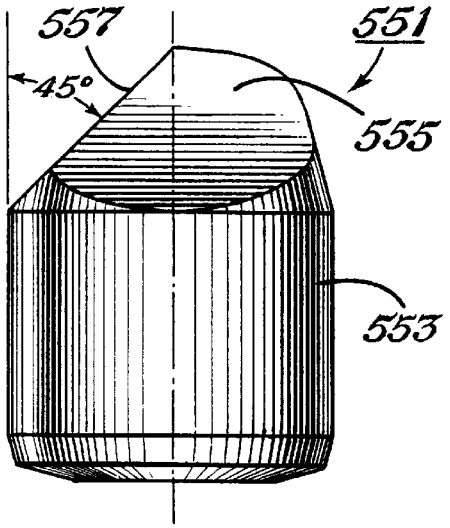
FIG. 12 is an elevation view of the cutting element of FIG. 11.

FIGS. 11 and 12 are plan and elevation views, respectively, of a scraper cutting element 551 according to a preferred embodiment of the present invention. Scraper element 551 comprises a cylindrical body 553 formed of a hard metal such as cemented tungsten carbide. A cutting end extends from cylindrical body 553 and comprises a pair of flanks 555, which converge to define a crest. According to the preferred embodiment of the present invention, an outermost surface 557 is formed by grinding or otherwise forming a generally flat surface at the outermost portion of element 551. Outermost surface 557 preferably is formed at approximately 45° from vertical. Because the basic element is chisel-shaped, the intersection of outermost surface 557 is triangular or wedge-shaped. The intersection of outermost surface 557 with the crest defined by flanks 555 defines a plow point or edge 559, which takes the form of a circular radius. In other configurations, plow point 559 could comprise a sharp corner or a chamfered point, as described in commonly assigned U.S. Pat. No. 5,346,026, Sep. 13, 1994 to Pessier et al. The edges of outermost surface 557 diverge at 45° from plow point 559 to permit flow of cuttings and material away from plow point 559 and cutting element 551, as described more fully below.

According to the present invention, scraper cutting element 551 is secured to the cutter at the generally circular juncture between gage and heel surfaces 31, 41 such that outermost surface 557 is generally aligned with gage surface 31. Outermost surface 557 may also be relieved between about three and about 15 degrees, such that it is not in parallel alignment with gage surface 31. Alternatively, scrapper insert 551 can also be secured to heel surface 41 to act as a more conventional heel element, but outermost surface 557 should still be generally aligned with gage surface 31.

Figure 13:
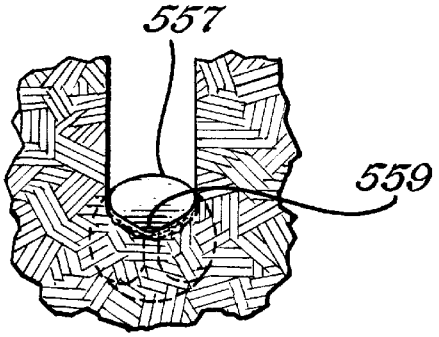
FIG. 13 is a fragmentary view, partially in section, of the cutting element of FIGS. 11 and 12 in drilling operation.

FIG. 13 is a fragmentary view, partially in section, of the cutting element of FIGS. 11 and 12 during drilling operation. As can be seen, upon shearing engagement with the sidewall of the borehole, cuttings are generated by the shearing action of plow point or edge 559 and outermost surface 557. Because of the divergence of the edges of outermost surface 557 from plow point or edge 559, cuttings and formation material move away from and around plow point or edge 559 and cutting element 551, moving up the borehole freely. This action prevents packing of the cuttings in front of a broad or wide cutting edge, which can lead to balling of the cutting element and bit.

Figure 14:
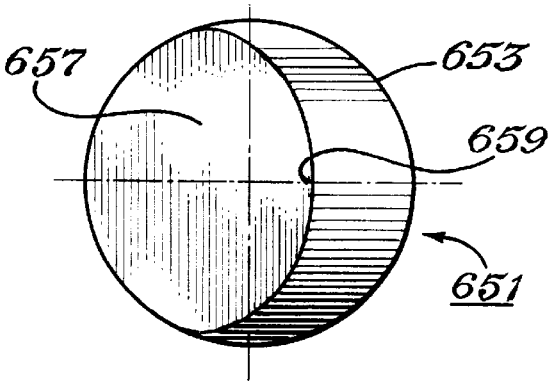
FIG. 14 is a plan view of a cutting element according to the preferred embodiment of the present invention.
Figure 15:
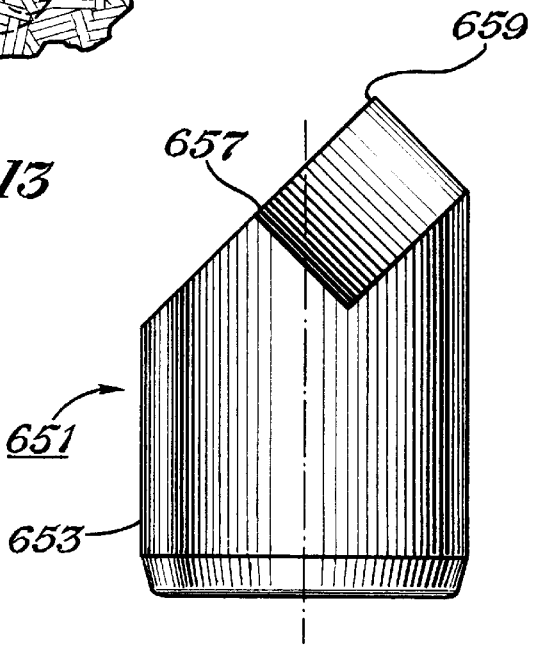
FIG. 15 is an elevation view of the cutting element of FIG. 14.

FIGS. 14 and 15 are plan and elevation views, respectively, of an alternative embodiment of a scraper cutting element 651 according to the present invention. In this embodiment, cutting element body 653 is a cylinder of hard metal, which is truncated at an angle to define an elliptical outermost surface 657 and a plow point or edge 659 at its uppermost extent. As with the embodiment of FIGS. 11 and 12, the edges or sides of outermost surface 657 diverge from plow point or edge 659 to provide for removal of cuttings or formation material. According to the preferred embodiment of the present invention, at least plow point 659 and a portion of outermost surface 657 are formed of super-hard material, such as polycrystalline diamond to enhance the wear-resistance of cutting elements 651.

With reference now to FIGS. 1 and 3A–15, the operation of improved earth-boring bit 11 according to the present invention will be described. Earth-boring bit 11 is connected into a drillstring (not shown). Bit 11 and drillstring are rotated in a borehole causing cutters 21, 23, 25 to roll and slide over bottom 201 of the borehole. The elements or teeth of cutters 21, 23, 25 penetrate and crush formation material, which is lifted up the borehole to the surface by drilling fluid exiting nozzle 19 in bit 11.

Heel elements or teeth 43 and gage elements 33 or chisel-shaped cutting elements 61 cooperate to scrape and crush formation material in corner 203 and on sidewall 205 of the borehole, thereby maintaining a full gage or diameter borehole and increasing the rate of penetration of bit 11 through formation material. Scraper elements 51, being secondary cutting structure, contribute to the disintegration of hard, tough, and abrasive intervals when the formation material forms enlarged rock ribs extending from corner 203 up sidewall 205 of the borehole. During drilling of the softer formation materials, scraper elements make only incidental contact with formation material, thus avoiding reduction in unit load on primary cutting structure such as heel elements 43.

As heel elements or teeth 43 wear, scraper elements 51 become engaged, protect the cutter shell surface from abrasive erosion and conformity with sidewall 205 of the borehole, and cooperate in the efficient cutting of sidewall 205 of the borehole by gage elements 33 or chisel-shaped cutting elements 61. Thus, earth-boring bit 11 according to the present invention is less susceptible to the rounded gage condition and the attendant increased lateral loading of cutters 21, 23, 25, inefficient gage cutting, and resulting reduced rates of penetration.

Additionally, chisel-shaped cutting elements 61 on gage surface 31, oriented in the direction of cut, aggressively cut formation material at the sidewall of the borehole, giving full coverage or redundance in the difficult task of generating the borehole wall.

The principal advantage of the improved earth-boring bit according to the present invention is that it possesses the ability to maintain an efficient and effective cutting geometry over the drilling life of the bit, resulting in a bit having a higher rate of penetration through both soft and hard formation materials, which results in more efficient and less costly drilling.

The invention is described with reference to a preferred embodiment thereof. The invention is thus not limited, but is susceptible to variation and modification without departing from the scope and spirit thereof.

We claim:

1. An earth-boring bit comprising:

a bit body;

at least one cantilevered bearing shaft depending from the bit body;

a cutter mounted for rotation on the bearing shaft, the cutter including a gage surface and a heel surface;

at least one scraper cutting element secured at least partially to the heel surface and having an outermost surface generally aligned with the gage surface, the outermost surface defining a plow point for shearing engagement with the sidewall of the borehole and having edges diverging from the plow point to promote flow of cuttings up the borehole.

2. The earth-boring bit according to claim 1 wherein the outermost surface of the scraper cutting element is wedge-shaped and the plow point is a radius.

3. The earth-boring bit according to claim 1 wherein the scraper cutting element is secured to a generally circular juncture defined between the gage and heel surfaces of the cutter and alternates between cutting elements secured to the heel surface of the cutter.

4. The earth-boring bit according to claim 1 wherein the outermost surface of the scraper cutting element is elliptical and the plow point is a radius.

5. The earth-boring bit according to claim 1 wherein the outermost surface of the scraper cutting element is relieved between about 3 and about 15 degrees from the sidewall of the borehole.

6. The earth-boring bit according to claim 1 further comprising a plurality of hard metal elements arranged in generally circumferential rows on the cutter and secured thereto by interference fit.

7. The earth-boring bit according to claim 1 further comprising a plurality of milled teeth, formed from the material of the cutter, arranged in circumferential rows on the cutter.

8. An earth-boring bit comprising:

a bit body;

at least one cantilevered bearing shaft depending from the bit body;

a cutter mounted for rotation on the bearing shaft, the cutter including a gage surface and a heel surface;

at least one scraper cutting element secured at least partially to the heel surface and having an outermost surface generally aligned with the gage surface, the outermost surface being wedge shaped and defining a plow point for shearing engagement with the sidewall of the borehole and having edges diverging from the plow point to promote flow of cuttings up the borehole.

9. The earth-boring bit according to claim 8 wherein the outermost surface of the scraper cutting element is wedge-shaped and the plow point is a radius.

10. The earth-boring bit according to claim 8 wherein the scraper cutting element is secured to a generally circular juncture defined between the gage and heel surfaces of the cutter and alternates between cutting elements secured to the heel surface of the cutter.

11. The earth-boring bit according to claim 1 wherein the outermost surface of the scraper cutting element is relieved between about 3 and about 15 degrees from the sidewall of the borehole.

12. The earth-boring bit according to claim 8 further comprising a plurality of hard metal elements arranged in generally circumferential rows on the cutter and secured thereto by interference fit.

13. The earth-boring bit according to claim 8 further comprising at plurality of milled teeth, formed from the material of the cutter, arranged in circumferential rows on the cutter.

14. An earth-boring bit comprising:

a bit body;

at least one cantilevered bearing shaft depending from the bit body;

a cutter mounted for rotation on the bearing shaft, the cutter including a gage surface and a heel surface;

at least one scraper cutting element secured to a generally circular juncture defined between the gage and heel surfaces, the scraper cutting element having an outermost surface generally aligned with the gage surface, the outermost surface defining a plow point for shearing engagement with the sidewall of the borehole and having edges diverging from the plow point to promote flow of cuttings up the borehole.

15. The earth-boring bit according to claim 14 wherein the outermost surface of the scraper cutting element is wedge-shaped and the plow point is a radius.

16. The earth-boring bit according to claim 14 wherein the outermost surface of the scraper cutting element is elliptical and the plow point is a radius.

17. The earth-boring bit according to claim 14 wherein the outermost surface of the scraper cutting element is relieved between about 3 and about 15 degrees from the sidewall of the borehole.

18. The earth-boring bit according to claim 14 further comprising a plurality of hard metal elements arranged in generally circumferential rows on the cutter and secured thereto by interference fit.

19. The earth-boring bit according to claim 14 further comprising a plurality of milled teeth, formed from the material of the cutter, arranged in circumferential rows on the cutter.

20. An earth-boring bit comprising:

a bit body;

at least one cantilevered bearing shaft depending from the bit body;

a cutter mounted for rotation on the bearing shaft, the cutter including a gage surface and a heel surface and a plurality of hard metal cutting elements arranged in circumferential rows and secured to the cutter by interference fit;

at least one scraper cutting element secured at least partially to the heel surface, the scraper cutting element including an outermost surface generally aligned with the gage surface, the outermost surface defining a plow point for shearing engagement with the sidewall of the borehole and having edges diverging from the plow point to promote flow of cuttings up the borehole.

21. The earth-boring bit according to claim 20 wherein the outermost surface of the scraper cutting element is wedge-shaped and the plow point is a radius.

22. The earth-boring bit according to claim 20 wherein the outermost surface of the scraper cutting element is elliptical and the plow point is a radius.

23. The earth-boring bit according to claim 20 wherein the outermost surface of the scraper cutting element is relieved between about 3 and about 15 degrees from the sidewall of the borehole.

24. The earth-boring bit according to claim 20 wherein the scraper cutting element is secured to a generally circular juncture defined between the gage and heel surfaces of the cutter and alternates between cutting elements secured to the heel surface of the cutter.

* * * * *

UNITED STATES PATENT AND TRADEMARK OFFICE

CERTIFICATE OF CORRECTION

PATENT NO. : 5,819,861

DATED : October 13, 1998

INVENTOR(S) : Danny Eugene Scott, et. al.

It is certified that error appears in the above-identified patent and that said Letters Patent is hereby corrected as shown below:

Column 4, Line 32, "or" should be --a--;

Column 4, Line 48, after "element" insert --51--;

Column 4, Line 57, second "a" should be the Greek letter --alpha--;

Column 5, Line 30, "sidewall" should be --Sidewall--;

Column 6, Line 22, delete "a";

Column 10, Line 16, "scrapper" should be --scraper--;

Column 10, Line 48, after "and" insert --the--;

Column 11, Line 33, after ";", insert --and--;

Column 12, Line 2, after second "surface", insert --and--;

Column 12, Line 35, after ";", insert --and--;

UNITED STATES PATENT AND TRADEMARK OFFICE

CERTIFICATE OF CORRECTION

PATENT NO. : 5,819,861
DATED : October 13, 1998
INVENTOR(S) : Danny Eugene Scott, et. al.

It is certified that error appears in the above-identified patent and that said Letters Patent is hereby corrected as shown below:

Column 13, Line 3, after ";" insert --and--.

Signed and Sealed this

Sixth Day of April, 1999

*Attest:*

Q. TODD DICKINSON

*Attesting Officer*

*Acting Commissioner of Patents and Trademarks*